United States Patent [19]

Hoffman

[11] 4,373,636

[45] Feb. 15, 1983

[54] CONTAINER

[76] Inventor: Louis S. Hoffman, Evan Farm Rd., Morris Township, Morris County, N.J. 07960

[21] Appl. No.: 235,754

[22] Filed: Feb. 18, 1981

[51] Int. Cl.[3] ..... B65D 85/72; A45C 11/20; A23B 7/14; B65D 51/16

[52] U.S. Cl. ..... 206/551; 206/545; 229/2.5 R; 229/43; 220/366

[58] Field of Search ..... 206/551, 550, 545; 229/2.5 R, 43; 220/366

[56] References Cited

U.S. PATENT DOCUMENTS

| | | | |
|---|---|---|---|
| 3,151,799 | 10/1964 | Engles, Jr. et al. | 229/2.5 |
| 3,261,530 | 7/1966 | Cave | 206/551 |
| 3,436,231 | 4/1969 | Bruce et al. | 229/2.5 |
| 3,464,832 | 9/1969 | Mullinix | 229/43 |
| 3,480,197 | 11/1969 | Massey | 229/43 |
| 3,708,086 | 1/1973 | Colato | 220/366 |
| 4,058,214 | 11/1977 | Mancuso | 220/366 |

*Primary Examiner*—William T. Dixson, Jr.
*Attorney, Agent, or Firm*—Kenyon & Kenyon

[57] ABSTRACT

The tray is provided with ribs across the base to provide air flow passages under a hot pizza pie or slice to prevent the pizza from becoming soggy. The ribs also serve to stiffen the tray. The wall of the tray may also be provided with vertical ribs. A ledge is provided to receive an imperforate cover and integral protuberances or flanges on the tray secure the cover in place. In one embodiment, the wall of the tray is sloped to facilitate removal of a pizza slice.

27 Claims, 12 Drawing Figures

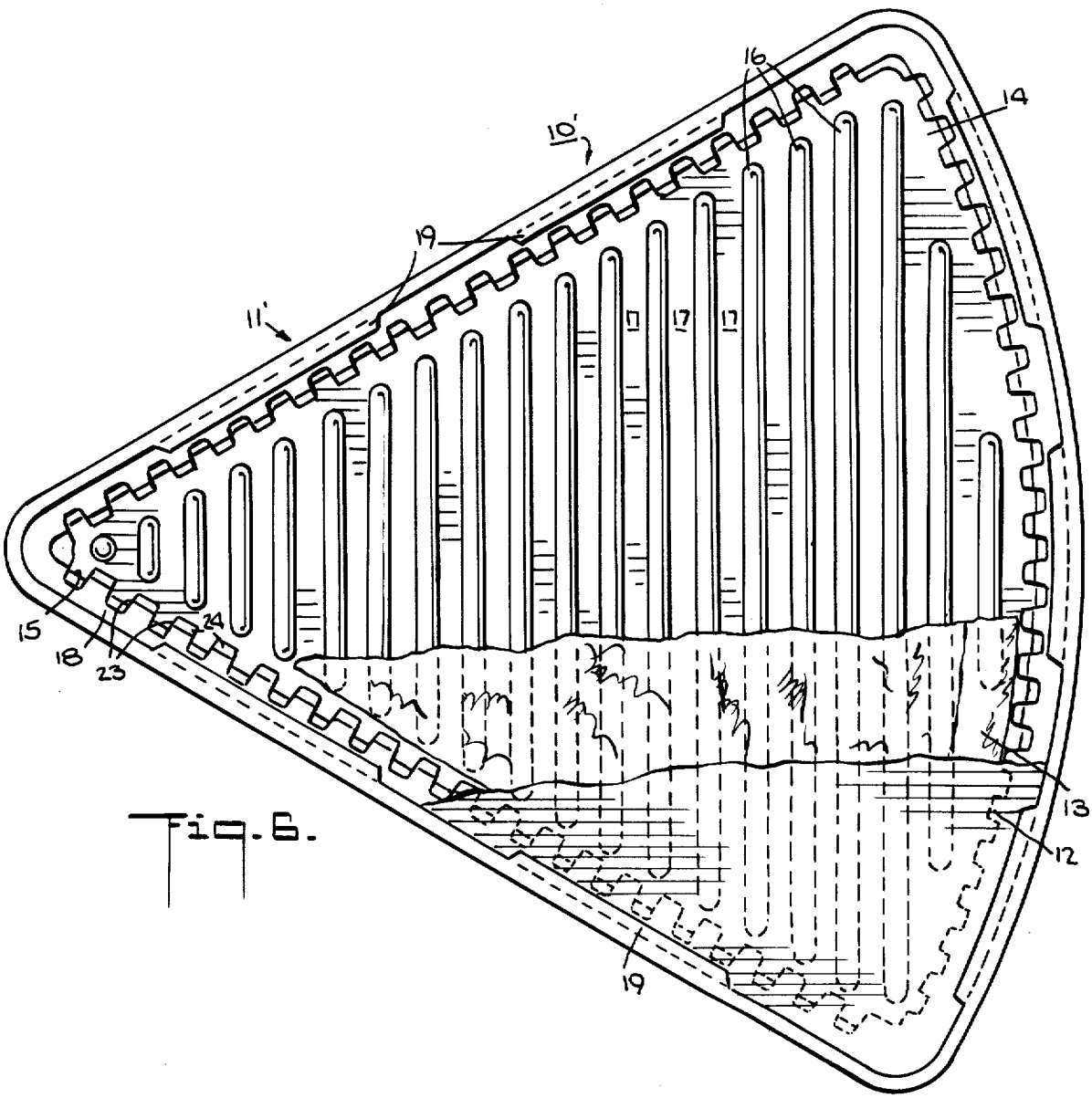
Fig. 6.
Fig. 7.
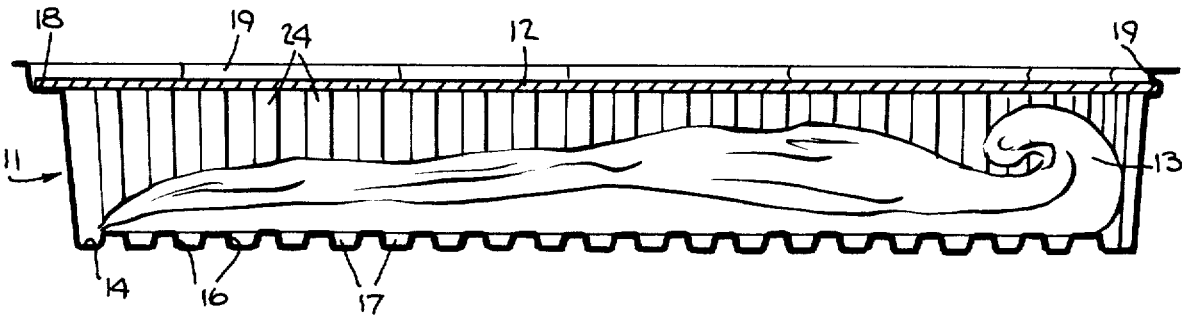

CONTAINER

This invention relates to a container. More particularly, this invention relates to a container for heated food products. Still more particularly, this invention relates to a container for pizza pies or slices thereof.

Heretofore, it has been known to provide various types of containers or boxes for transferring heated food products such as pizza pies or slices from one place to another. For example, it has been known to place hot pizza from an oven into a cardboard box for delivery to an ultimate consumer at a remote location. The box is generally intended to not only protect the pizza from contamination but also to maintain the pizza in a heated condition until arrival at the ultimate consumer. However, it has been found that pizzas which are packaged in cardboard boxes tend to become soggy after a relatively short period of time. As a result, the taste and texture of the pizzas are less desirable to the ultimate consumer.

In order to prevent a pizza from becoming soggy during transportation, it has been known to construct a container, such as described in U.S. Pat. No. 3,335,846, with a recessed tray-like base shaped to receive a complete pizza pie and a cover which forms a lid over the base in press fitted relation and is provided with one or more vent openings so that steam and other vapors can escape. Even though the vent openings should prevent the vapors generated within the container from recondensing within the container and causing the pizza to become soggy, experience has shown that the venting of a container for hot pizza does not accomplish this purpose.

Accordingly, it is an object of the invention to provide a container for a pizza which prevents a packaged pizza from becoming soggy.

It is another object of the invention to transport pizza in a sealed manner while maintaining freshness.

It is another object of the invention to provide a container for transportating heated pizza in a relatively simple manner while maintaining the oven-baked texture of the pizza.

Briefly, the invention provides a container which is comprised of a tray of predetermined geometric shape and a cover. The tray is made with a base, a peripheral wall which defines a chamber and a plurality of raised elongated ribs on the base for receiving a pizza thereon while defining air flow passages therebetween. The cover is removably mounted on the wall of the tray to enclose the chamber.

The tray is of thin-walled construction and is shaped to transport one or more slices of pizza or an entire pizza. To this end, the shape may be triangular, rectangular, square or circular. The ribs are disposed in various manners depending upon the shape of the tray. For example, for a tray of triangular shape, the ribs are disposed in parallel relation to each other while for a tray of circular shape, the ribs are disposed in a radiating pattern. Each rib is of suitable size to maintain the pizza at a raised elevation over the base of the tray while permitting air to flow under the pizza.

In one embodiment, the peripheral wall of the tray has a ledge spaced above the base and means, such as protuberances which are spaced above the ledge, for releaseably securing the cover on the ledge.

In another embodiment, the peripheral wall of the tray has a plurality of outwardly directed flanges at an upper end while the cover has a plurality of slits such that each flange extends through a respective slit to secure the cover to the tray.

The wall of the tray may also have a sloped wall section which extends from the base to permit sliding of a pizza slice from the tray upon opening of a closed container.

The tray may be made of a material selected from the group consisting of solid plastic and foamed plastic while the cover is made of any suitable material such as cardboard.

In accordance with the invention, the cover is imperforate so that the heat which is generated by the heated pizza is maintained within the closed container during transportation. The retention of this heat serves to maintain the heat within the pizza as much as possible.

It has been found that the air flow within the enclosed container is such that the heated air flowing under the pizza within the passageways between the ribs does not permit the pizza to become soggy. Thus, the ultimate consumer can be presented with a pizza slice or pizza which retains as much as possible the oven-baked texture and flavor of the pizza.

These and other objects and advantages of the invention will become more apparent from the following detailed description taken in conjunction with the accompanying drawings in which:

FIG. 6 illustrates a plan view similar to FIG. 2 of a modified container in accordance with the invention;

FIG. 7 illustrates a view taken on line 7—7 of FIG. 6;

Figure 1:
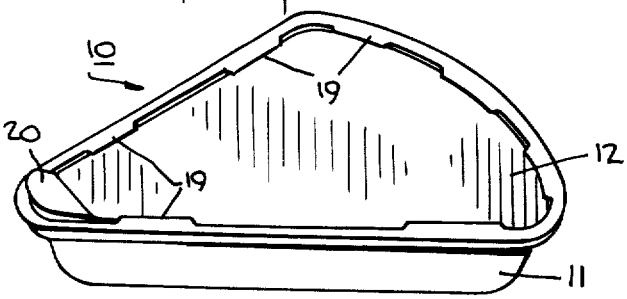
FIG. 1 illustrates a perspective view of a container according to the invention.

Referring to FIG. 1, the container 10 is comprised of a tray 11 and a cover 12 which is removably mounted on the tray 11.

Figure 2:
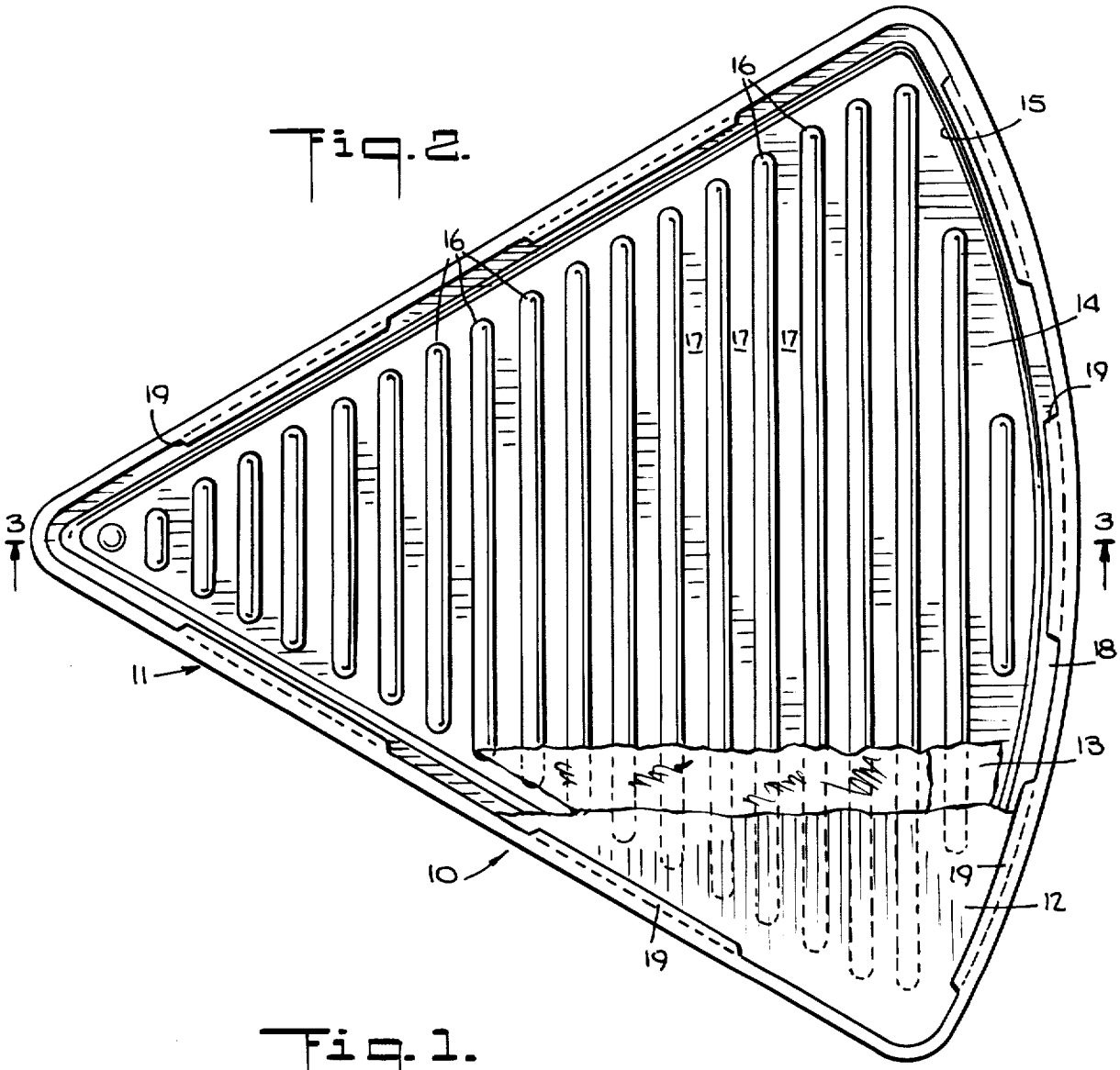
FIG. 2 illustrates a fragmentary top view of a container having a pizza slice therein in accordance with the invention.
Figure 4:
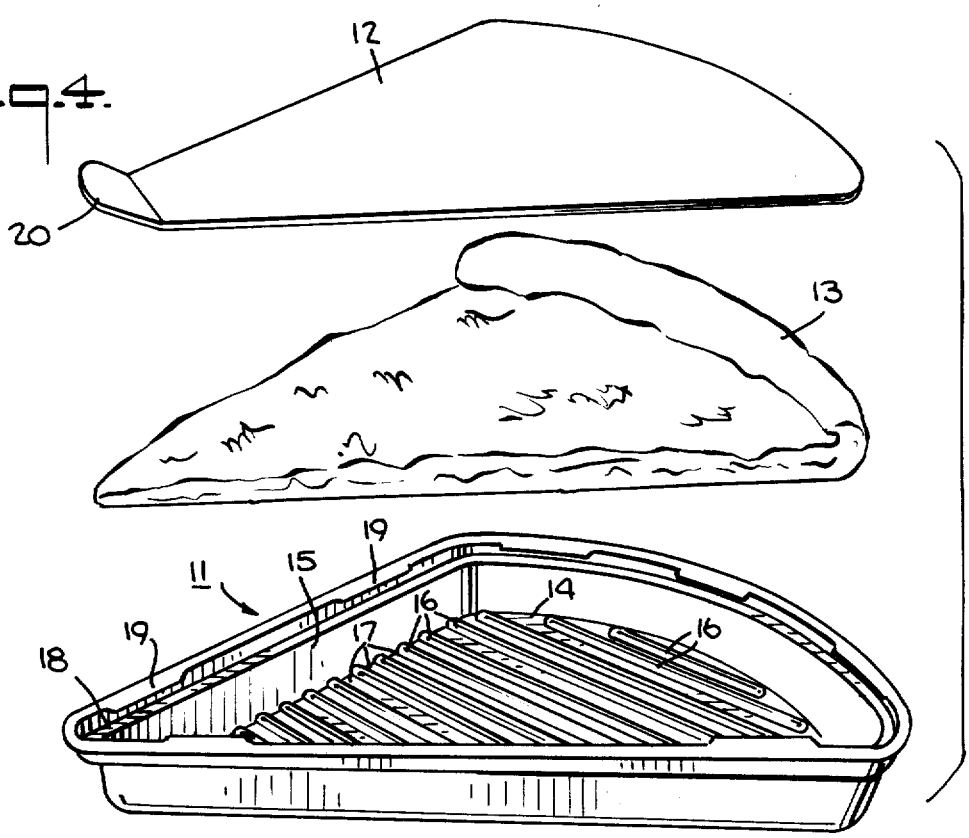
FIG. 4 illustrates an exploded view of the container of FIG. 2.

Referring to FIGS. 2 and 4, the tray 11 is of a predetermined geometric shape corresponding to the shape of the pizza 13 to be packaged. For example, as shown, the tray 11 is of triangular shape so as to receive a pizza wedge of triangular shape. In addition, the tray 11 is of thin-walled construction, for example of a thickness of 0.010 inches, and is made, for example, by molding, in one piece of a material selected from the group consisting of solid plastic and foamed plastic.

The tray 11 includes a base 14, a peripheral wall 15 which defines a chamber and a plurality of raised elongated ribs 16 on the base 14 for receiving the pizza slice 13 thereon.

The ribs 16 are disposed in parallel relationship to each other and extend substantially across the entire width of the base 14 where the ribs 16 are located i.e.

parallel to the base of the triangle formed by the tray 11. The ribs 16 are spaced from each other to define air flow passages 17 therebetween and are sized to maintain the pizza slice 13 at a sufficient height above the base 14 so that air may flow through the passages 17. For example, the ribs are sized to have a height of approximately one-eighth inch and a width of approximately one-eighth inch while being spaced apart at approximately three-sixteenths inch. However, the spacing, height and width of the ribs may be of any suitable dimensions which are sufficient to permit a flow of air between the ribs 16 under a pizza slice 13 in order to prevent the pizza slice 13 from becoming soggy. As shown, each rib 16 has end portions which are spaced from a respective portion of the wall 15 so that the air flow passages are open at the end portions to the wall 15. The ribs 16 also serve to stiffen the thinwall base 14 against sagging.

The peripheral wall 15 has a ledge 18 spaced above the base 14 for receiving the cover 12 thereon and means in the form of protuberances 19 spaced above the ledge 18 in order to releaseably secure the cover 12 on the ledge 18. As shown in FIG. 2, the protuberances 19 are spaced above the three sides of the peripheral wall 15 and are integral with the wall 15.

The wall 15 is sufficiently flexible so as to permit the cover 12 to be snapped into place under the protuberances 19. In addition, the cover 12 is provided with a tab 20 at the apex. This tab is normally flat and disposed against the ledge 18 during transport of the container 10. When the container 10 is to be opened, the tab 20 is lifted, for example to the position shown in FIG. 1, so that the cover 12 can then be pulled off the tray 11 manually.

Figure 3:
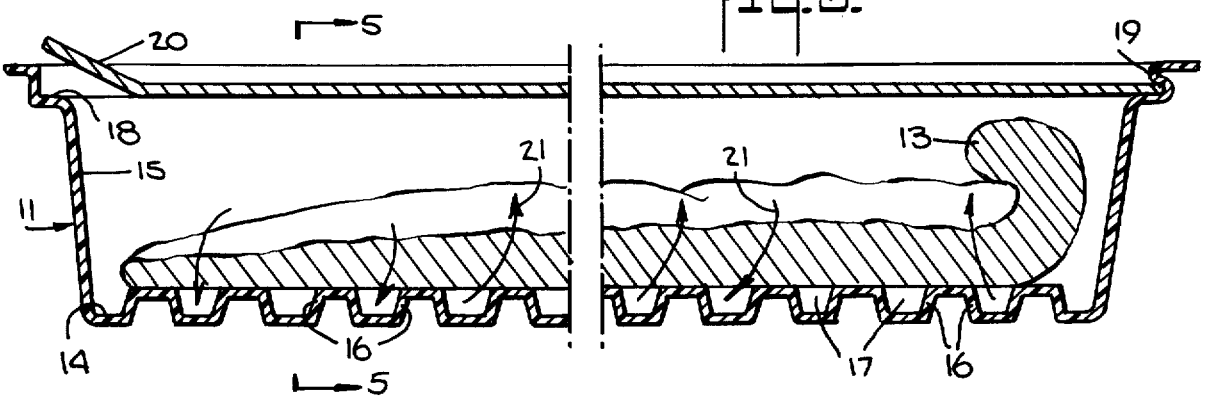
FIG. 3 illustrates a view taken on line 3—3 of FIG. 2.
Figure 5:
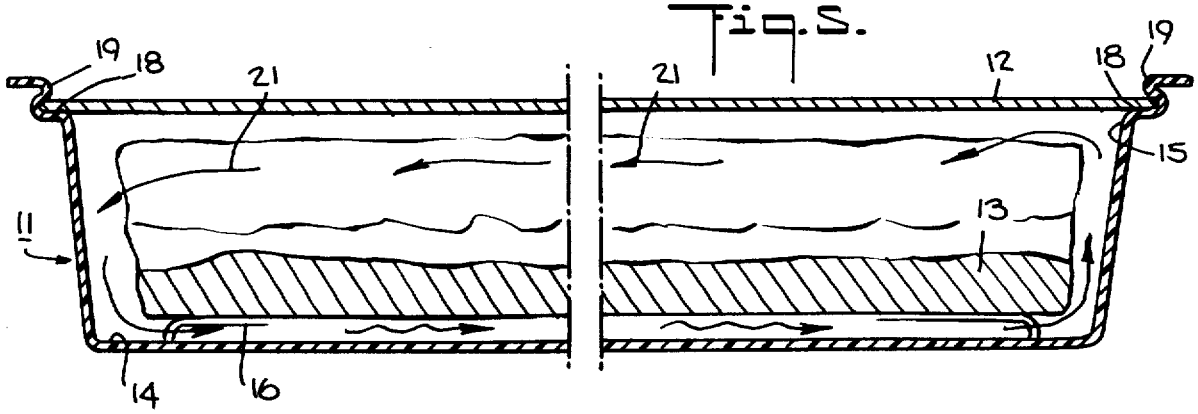
FIG. 5 illustrates a view taken on line 5—5 of FIG. 3.

Referring to FIGS. 3 and 5, when the pizza slice 13 is packaged within the container 10, the heated vapor within the container tends to follow a flow path as indicated by the flow lines 21 by circulating from the space above the pizza slice 13 downwardly along the wall 15 and thence under the pizza slice 13 along the passages 17 formed between the ribs 16 before rising up along the wall 15 for recirculation over the pizza slice 13. This circulation of the heated air flow tends to maintain the heat generated by the pizza slice within the closed container 10 while at the same time preventing the bottom or crust 22 of the pizza slice 13 from becoming soggy.

Referring to FIGS. 6 and 7, wherein like reference characters indicate like parts as above, the ledge 18' may have a plurality of spaced apart recesses 123 formed therein which communicate with the chamber defined by the tray 11'. These recesses 23 serve to reinforce the ledge 18' against buckling when the cover 12 is pressed into place. In addition, the peripheral wall 15 is provided with vertical ribs 24 so as to enhance channeling of the air flow along the wall 15 an well as to stiffen the wall 15. These vertical ribs 24 extend from the base 14 of the tray 11' to the height of the ledge 18' on the wall 15.

Figure 8:
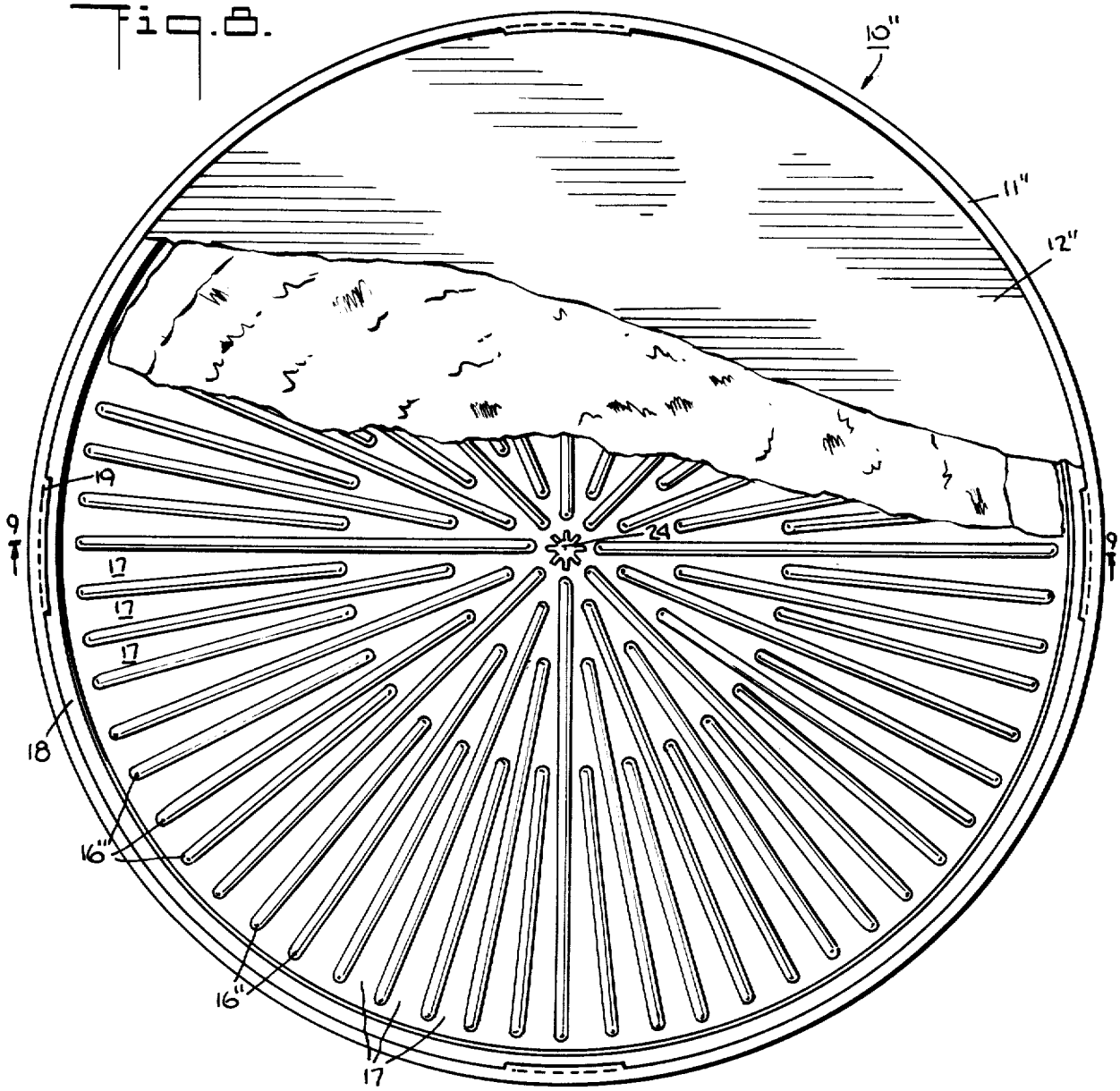
FIG. 8 illustrates a view of a modified container in accordance with the invention for a whole pizza.
Figure 9:
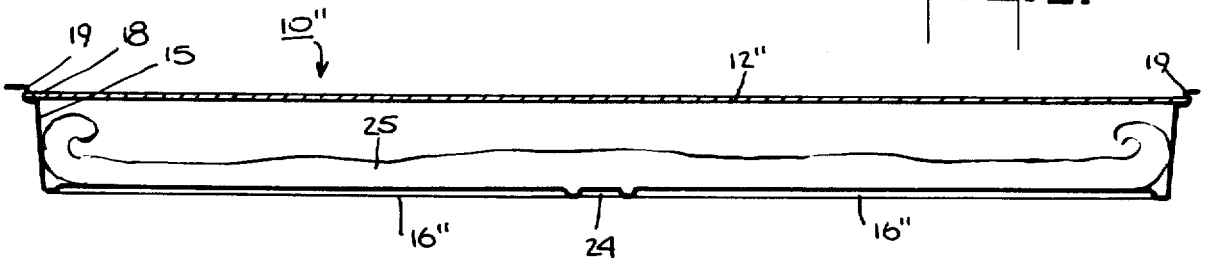
FIG. 9 illustrates a cross-sectional view taken on line 9—9 of FIG. 8.

Referring to FIGS. 8 and 9, wherein like reference characters indicate like parts as above, the container 10'' has a tray of 11'' of circular shape and a cover 12'' of like circular shape. In addition, the ribs 16'' within the tray 11'' are disposed in a radiating pattern. The center of the tray 11'' may also be formed with a raised projection 24 complementary to the ribs 16''.

As indicated in FIGS. 8 and 9, a whole pizza 25 of circular shape is disposed within the container 10''. As above, the ribs 16'' form air flow passages 17 of sufficient size to permit air to flow through the passages 17 under the pizza 25 and, thereafter, over the pizza 25.

Figure 10:
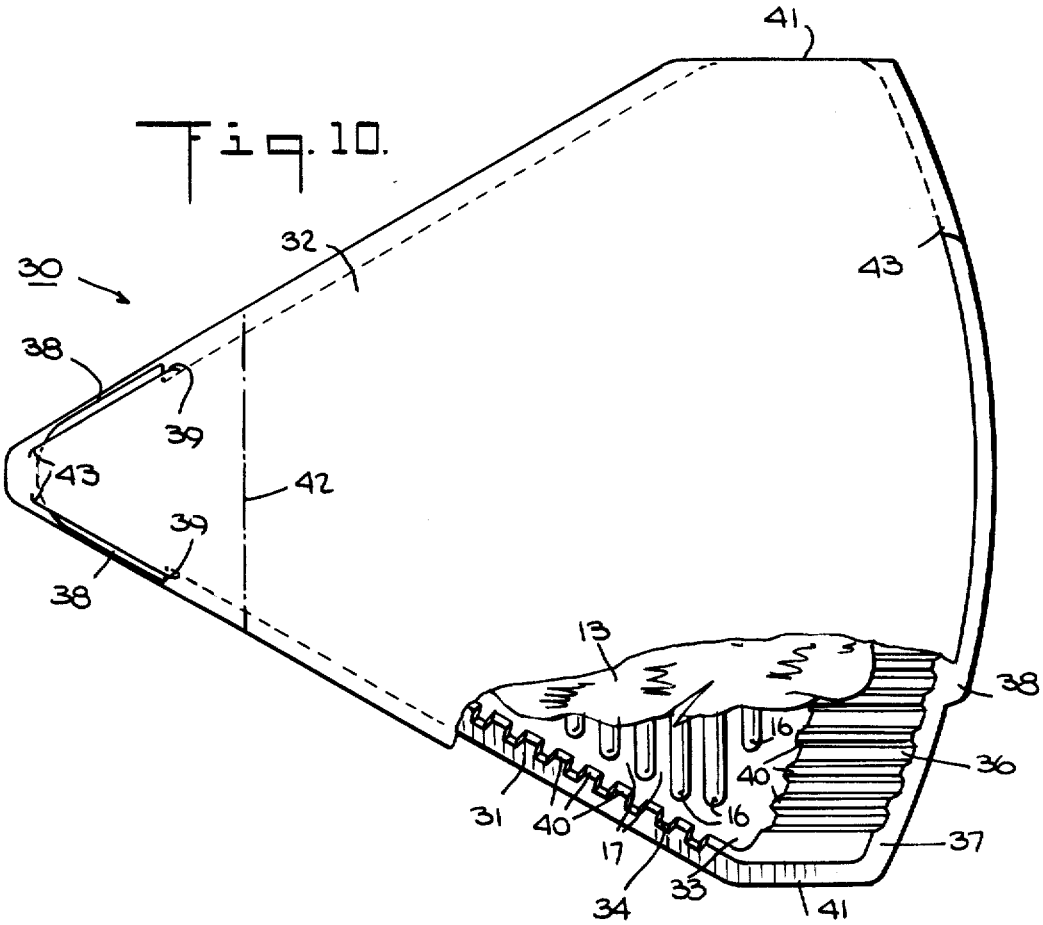
FIG. 10 illustrates a partially broken plan view of a modified container in accordance with the invention.
Figure 11:
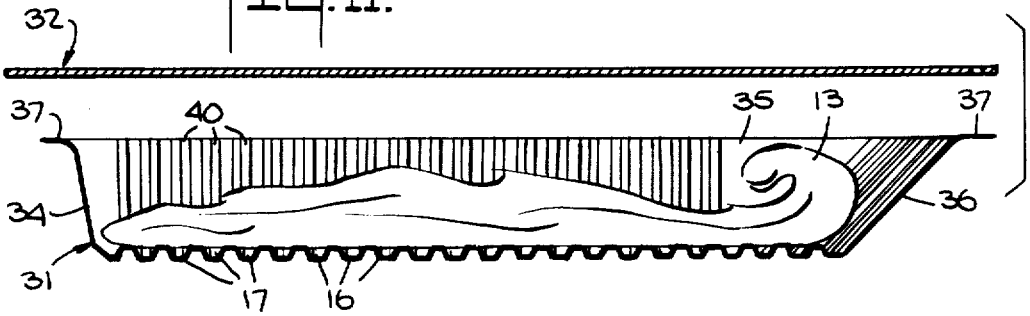
FIG. 11 illustrates an exploded cross-sectional side view of the container of FIG. 10.
Figure 12:
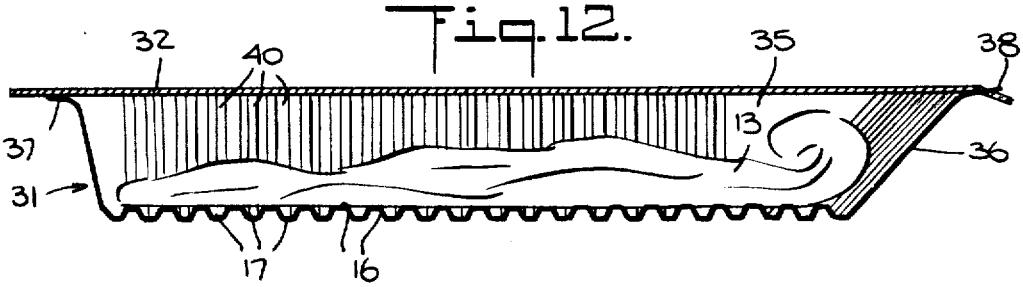
FIG. 12 illustrates a cross-sectional side view of the container of FIG. 10.

Referring to FIGS. 10 to 12, wherein like reference characters indicate like parts as above, the container 30 is comprised of a tray 31 and a cover 32 which is mounted on the top of the tray 31. As shown, the tray 31 has a base 33 of triangular shape and a peripheral wall 34 which has two upstanding substantially vertical sections 35 and a sloped rear section 36 of slightly rounded shape. In addition, the wall 34 has a flat peripheral ledge 37 at the upper end and a plurality of spaced apart outwardly directed thin flat flanges 38. The ledge 37 extends outwardly of the tray wall 34, for example, about one-quarter inch while the flanges 38 extend further, for example, about two-tenths of an inch. The flanges 38 are located with one intermediately of the sloped rear section 36 and the others at the apex defined by the upstanding wall sections 35. These latter two flanges 38 merge together and each has an inwardly directed notch 39 at the opposite end for purposes as described below. The flange 38 on the rear wall section 36 is rounded at the ends as viewed in FIG. 10.

The tray 31 includes ribs 40 on the wall sections 35, 36 which extend upwardly from the base 33 for similar purposes as the ribs 24 as shown in FIG. 6.

The sloped rear wall section 36 is disposed at an angle of about 45° relative to the base 33 and allows a pizza slice 13 to be slid out of the tray 31 upon opening of the container 30. As indicated in FIG. 10, the upper end of the tray 31 is of generally triangular shape with a pair of straight sections 41 each of which is located between an angled side section and a rounded rear section.

The cover 32 is flat and imperforate and is shaped to the contour of the tray 31. As indicated, the cover 32 overhangs the ledge 37 of the tray 31; for example, a distance of about one-quarter inch. The cover 32 is provided with a score line 42 and three slits 42. Each slit 43 is located, sized and shaped to receive a flange 38 of the tray 31 in slide-fit relation so that the cover 32 can be secured to the tray 31. As shown in FIG. 10, the ends of the flanges 38 at the apex of the tray 31 extend through the slits 43 in hook-like fashion due to the notches 39 to retain the cover 31 in place.

In use, after a heated pizza slice 13 is placed in the tray 31, the cover 32 is brought down onto the ledge 37 and the three flanges 38 slide through the slits 43 to secure the cover 32 in place. Thereafter, in order to remove the pizza slice 13, the rear section of the cover 32 is lifted from the tray 31 to slide the rounded flange 38 out of rounded slit 39. The cover 32 is then folded on the score line 42 to expose the pizza slice 13. The pizza slice 13 can then be slid out of the tray 31 over the sloped rear section 36. During this time, the cover 32 remains fixed to the tray 31 via the notched flanges 38 at the apex end of the tray 31. The pizza slice 13 is thus removable from the container 30 in a manner which minimizes spilling of the sauce and the like on the pizza, for example, out of the container 30 or onto the consumer.

The container may be of any suitable size depending upon the size of the pizza slices or pizza to be packaged. For example, the tray may have an overall height of about three-quarters of an inch to one and one-quarter inch for a pizza slice. Also, the tray and/or cover may be made of a clear plastic material so that the contents can be viewed.

The invention thus provides a container for pizza which is capable of maintaining a pizza in a heated condition during transportation without having the pizza become soggy.

The container is of relatively simple construction and can be formed in any suitable manner of relatively inexpensive materials.

What is claimed is:

1. A container for pizza comprising a tray of predetermined geometric shape having a base, a peripheral wall defining a chamber and a plurality of raised elongated ribs on said base for receiving pizza thereon while defining airflow passages therebetween; and a cover removably mounted on said wall of said tray to enclose said chamber.

2. A container as set forth in claim 1 wherein said ribs are in parallel spaced relation at a spacing of approximately three-sixteenths inch with a height of approximately one-eight inch and a width of approximately one-eight inch.

3. A container as set forth in claim 1 wherein said tray is made of a material selected from the group consisting of solid plastic and foamed plastic.

4. A container as set forth in claim 1 wherein said cover is made of cardboard.

5. A container as set forth in claim 1 wherein said cover is imperforate.

6. A container as set forth in claim 1 wherein said peripheral wall has a ledge spaced above said base receiving said cover thereon and means spaced above said ledge releaseably securing said cover on said ledge.

7. A container as set forth in claim 6 wherein said ledge has a plurality of spaced apart recesses communicating with said chamber.

8. A container as set forth in claim 1 wherein said tray and said cover are each of triangular shape.

9. A container as set forth in claim 8 wherein said cover has a tab at an apex thereof for removal of said cover from said tray.

10. A container as set forth in claim 1 wherein said tray and said cover are each of circular shape, and said ribs are radially disposed in spaced relation to each other.

11. A container as set forth in claim 1 wherein said tray includes a plurality of vertical ribs on said peripheral wall.

12. A container as set forth in claim 1 wherein said wall includes a plurality of outwardly directed flanges at an upper end and said cover includes a plurality of slits, each said flange extending through a respective slit to secure said cover to said tray.

13. A container as set forth in claim 1 wherein said base is of triangular shape and said wall includes a plurality of upstanding sections and a sloped rear section extending from said base for sliding of a pizza slice from said tray after opening of said cover.

14. A container as set forth in claim 13 wherein said sloped rear section has a plurality of raised ribs extending from said base.

15. A container as set forth in claim 1 wherein said ribs are in parallel spaced relation and extend between oppositely disposed portions of said peripheral wall, each said rib having oppositely disposed end portions spaced from a respective portion of said peripheral wall to define air flow passages open at each respective end portion to said peripheral wall.

16. A container comprising a tray of thin-walled construction and predetermined geometric shape having a base, a peripheral wall defining a chamber and having a ledge spaced above said base and protuberances spaced above said ledge, and a plurality of raised elongated ribs on said base defining airflow passages therebetween; and an imperforate cover removably mounted on said ledge and under said protuberances to enclose said chamber.

17. A container as set forth in claim 16 wherein said tray is made of a material selected from the group consisting of solid plastic and foamed plastic and said cover is made of cardboard.

18. A container as set forth in claim 16 wherein each rib has a height of approximately $\frac{1}{8}$ inch above said base and a width of approximately $\frac{1}{8}$ inch.

19. A container for a pizza slice comprising a tray having a base, a peripheral wall defining a chamber and a plurality of spaced apart flanges extending outwardly from said wall at an upper end thereof; and a cover removably mounted on said wall of said tray, said cover extending outwardly of said peripheral wall and having a plurality of spaced apart slits, each said slit having a respective flange of said tray extending therethrough to secure said cover to said tray.

20. A container as set forth in claim 19 wherein said wall includes a sloped section extending from said base to permit sliding of a pizza slice thereon upon opening of said container.

21. A container as set forth in claim 20 wherein said base is triangular.

22. A container as set forth in claim 19 wherein said cover is flat and imperforate.

23. A tray for pizza comprising a base, a peripheral wall about said base of triangular shape to define a chamber therewith; and a plurality of raised elongated ribs on said base for receiving pizza thereon, said ribs being disposed across said base to define airflow passages therebetween.

24. A tray as set forth in claim 23 wherein said ribs are parallel to each other.

25. A tray as set forth in claim 23 wherein said wall has a sloped section extending from said base to permit sliding of a pizza slice thereon.

26. A tray for pizza comprising:

a base of circular shape;

a peripheral wall about said circular base to define a chamber therewith; and a plurality of raised elongated ribs on said circular base for receiving pizza thereon, said ribs being disposed across said base to define airflow passages therebetween.

27. A tray as set forth in claim 26 wherein said ribs are disposed in a radiating pattern on said base.

* * * * *